US006821390B2

(12) United States Patent
Schadler et al.

(10) Patent No.: US 6,821,390 B2
(45) Date of Patent: Nov. 23, 2004

(54) PROCESS AND DEVICE TO CONTROL QUALITY PARAMETERS IN PAPER, TISSUE AND PULP DEWATERING PLANTS

(75) Inventors: Gerald Schadler, Vasoldberg (AT); Wilhelm Mausser, Graz (AT)

(73) Assignee: Andritz AG, Graz (AT)

( * ) Notice: Subject to any disclaimer, the term of this patent is extended or adjusted under 35 U.S.C. 154(b) by 311 days.

(21) Appl. No.: 10/100,795

(22) Filed: Mar. 18, 2002

(65) Prior Publication Data

US 2002/0148587 A1 Oct. 17, 2002

(30) Foreign Application Priority Data

Mar. 29, 2001 (AT) ..... A 507/2001

(51) Int. Cl.[7] ..... D21F 1/02

(52) U.S. Cl. ..... 162/212; 162/337; 162/343; 162/353

(58) Field of Search ..... 162/212, 353, 162/337, 343

(56) References Cited

U.S. PATENT DOCUMENTS 5,470,439 A * 11/1995 Makino et al. ..... 162/216

* cited by examiner

*Primary Examiner*—Peter Chin
(74) *Attorney, Agent, or Firm*—Alix, Yale & Ristas, LLP

(57) ABSTRACT

Apparatus and process for controlling the basis weight cross-profile, the formation, the fiber direction and other quality parameters of a pulp sheet after the headbox in a dewatering plant. The apparatus including at least one suspension feed, at least one distribution device and at least one drainage device for excess suspension from the distribution device, where the distribution device has a distribution chamber and a turbulence-generating chamber made up of a number of pipes adjacent to one another. It is mainly characterized by the two peripheral zones of the headbox, comprising distribution chamber and turbulence-generating chamber, each having a discharge device in the sheet running direction for a partial suspension stream.

11 Claims, 3 Drawing Sheets

PROCESS AND DEVICE TO CONTROL QUALITY PARAMETERS IN PAPER, TISSUE AND PULP DEWATERING PLANTS

BACKGROUND OF THE INVENTION

This invention relates generally to devices and processes for controlling quality parameters in dewatering plants. More particularly, the present invention relates to devices and processes for controlling the basis weight cross-profile, the formation, the fiber direction and other quality parameters of a pulp sheet after the headbox in paper, tissue and pulp dewatering plants, with at least one suspension feed, at least one distribution device and at least one drainage means for excess suspension from the distribution device, where the distribution device has a distribution chamber and a turbulence-generating chamber made up of a number of pipes adjacent to one another.

A number of facilities are known for controlling the pulp feed to a pulp sheet. DE 199 23 149 (Voith Sulzer Papiertechnik), for example, describes a device where the pressure is measured in the headbox nozzle and the flow rate of the excess pulp suspension drained off is controlled. This backflow is necessary in order to obtain virtually uniform distribution of pressure over the paper sheet width at the distribution device and thus, permit even flow of the pulp suspension onto the wire. In the peripheral zone (edge zones on tender and drive sides), however, turbulence occurs which leads to uneven concentrations and thus, to uneven basis weight, etc.

SUMMARY OF THE INVENTION

The aim of the invention is to improve or prevent the uneven quality characteristics discussed above.

The invention is thus characterized by the two peripheral zones of the headbox, comprising distribution chamber and turbulence-generating chamber, each having a discharge means in the sheet running direction for a partial suspension stream. By removing the suspension at the edges in sheet running direction, additional turbulence is prevented and the corresponding uneven zone at the edges is not fed to the pulp sheet, particularly the tissue or paper sheet.

A favorable further development of the invention is characterized by the distribution chamber extending beyond the sheet width on both sides of the headbox by the width of the irregular zones at the sheet edges, where the turbulence-generating chamber can also be widened over the sheet width on both sides of the headbox by the width of the irregular zones at the sheet edges and there can be several pipes in each case in these areas. As a result, those irregularities that are generally found at the edges of the pulp sheet are outside the sheet width that is to be further processed.

An advantageous configuration of the invention is characterized by the pipes at the edges of the turbulence-generating chamber being shortened in comparison to the other pipes, particularly to approximately one quarter of the length of the other pipes. The irregular pulp sheet edges are removed at the earliest possible point in the headbox and thus, are not fed through the headbox and on to the paper machine.

An advantageous further development of the invention is characterized by collecting lines being connected in each case to the outer pipes in the turbulence-generating chamber, particularly to the shortened pipes, where control fittings can be provided in the collecting lines. With these fittings it is possible to set the same pressure drop in the collecting lines at the side as prevails in the rest of the headbox and thus, prevent irregularities in inflow at the transition from the short to the long pipes in the turbulence generator.

A favorable configuration of the device according to the invention is characterized by appropriate discharge means being provided for each layer separately with multi-layer headboxes.

In an operating mode with differential speeds in the individual layers of a multi-layer headbox, different pressure drops occur in each layer. Thus, it is necessary to also be able to set the pressure drops separately in the discharge means at the sides.

The invention also refers to a process for controlling the cross-machine basis weight profile, the formation, the fiber orientation and other quality parameters of a pulp sheet after the headbox in paper, tissue and pulp dewatering machines, with at least one suspension feed, at least one distribution device and at least one discharge means for removing excess suspension from the distribution device.

It is characterized by one partial stream of the suspension being drained off in sheet running direction in both edge zones of the headbox, where the stream being drained off is the one that suffers turbulence due to deflection at the edges of the distribution device.

An advantageous further development of the invention is characterized by the partial streams removed being regulated. This allows the pressure losses at the lateral drainage points to be adapted to the remaining section of the headbox, thus preventing uneven flow conditions at the transition from the short to the long pipes in the turbulence block.

A favorable configuration of the invention is characterized by appropriate partial streams being removed for each layer separately in multi-layer headboxes. In this way, it is possible to set the speeds in the lateral outlets in multi-layer headboxes, which use differential speeds in the individual layers.

BRIEF DESCRIPTION OF THE DRAWINGS

The present invention may be better understood and its numerous objects and advantages will become apparent to those skilled in the art by reference to the accompanying drawings in which.

DETAILED DESCRIPTION OF THE PREFERRED EMBODIMENT

Figure 1:
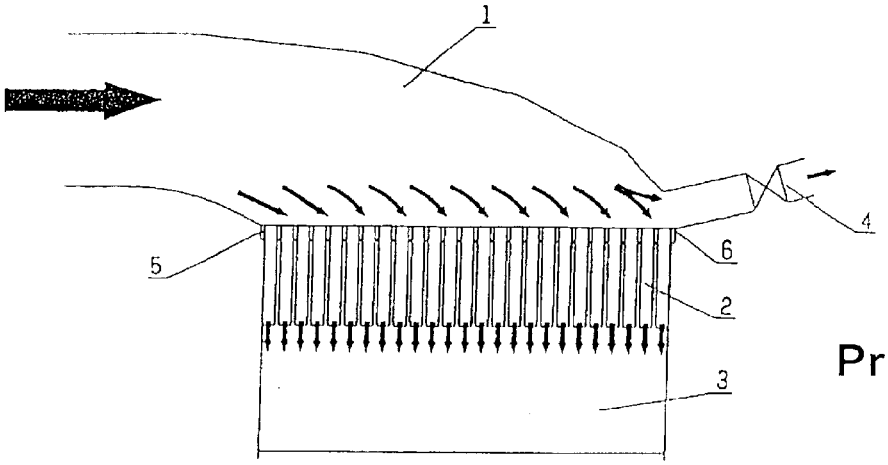
Prior Art Fig. 1
FIG. 1 is a schematic diagram of a conventional headbox.

FIG. 1 shows a headbox for a paper, tissue or pulp dewatering machine, where this headbox can have one, two or three layers. The (pulp) suspension is generally fed in from the drive side of the machine across the running direction of the pulp sheet, for example a paper sheet, to a distribution pipe 1. The pulp suspension is then diverted into the sheet running direction, after which it flows through a turbulence-generating chamber 2 made up of a row of adjacent pipes, followed by a nozzle chamber 3, and then arrives at the dewatering section, particularly on a wire in the machine. A return pipe 4 is provided at the tender side end of the distribution pipe 1.

Headboxes of this kind create differences in the quality parameters, such as basis weight cross profile, formation, and fiber orientation in the peripheral areas compared with the rest of the pulp sheet, especially paper sheet. The reason for this is mainly the turbulence areas at the deflection edges 5 and 6 between distribution pipe 1 and turbulence-generating chamber 2, where this turbulence continues through the entire headbox, leading to the above-mentioned differences and problems. In order to create an even sheet, for example, the edge strips are removed in the course of the production process and returned to it again as broke. As a result, all plant parts must have a total width that includes the edge strips and which thus cannot be used in its entirety to obtain the final production width.

Figure 2:
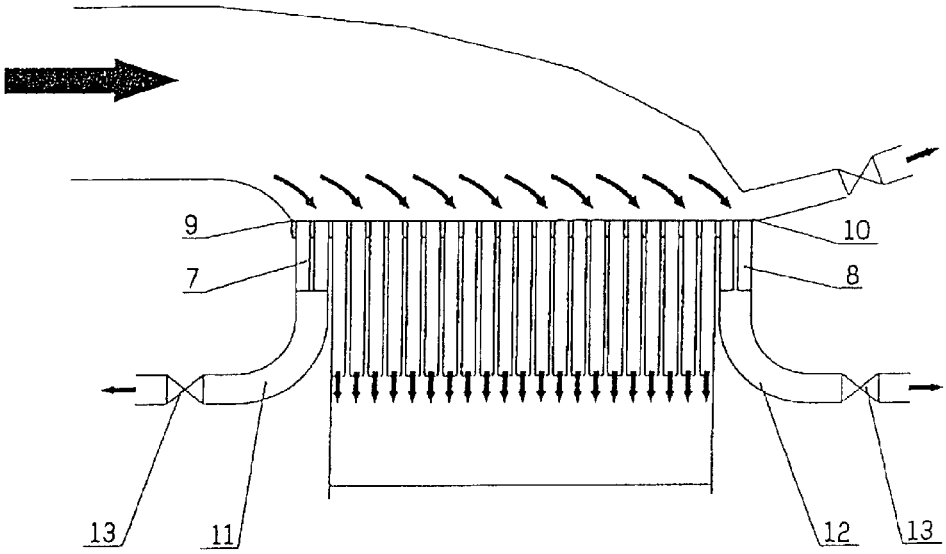
FIG. 2 is a schematic diagram of a single-layer headbox of a quality control system in accordance with the invention.

FIG. 2 now shows a headbox according to the invention. In order to avoid having to remove the edge strips afterwards, be this on the wire (by cutting with a water jet) or when dry (by an appropriate cutting device), and to allow use of the entire wire width and the full width of the subsequent units, the headbox is widened on both sides to an extent corresponding to the width of the irregular zones at the sheet edges. In order to do this the distribution pipe 1 and the turbulence-generating chamber 2 are widened accordingly. In the turbulence-generating chamber 2 the outer pipes 7 and 8, which are beyond the width of the pulp sheet, especially paper sheet, to be produced are shortened and connected to discharge means 11 and 12. These discharge means 11, 12 may also contain control valves 13. With this arrangement, the flow across the (paper) sheet width is no longer influenced by the deflection edges 9, 10 and is already deflected into the final flow direction. As a result, stable flow conditions also prevail in this sector. The pipes 7, 8 in the peripheral area are shortened. As a result, the pulp suspension in the lateral drainage area is not fed through the entire headbox and then onto the paper machine.

In multi-layer headboxes, an appropriate discharge means is provided for each layer.

Figure 3:
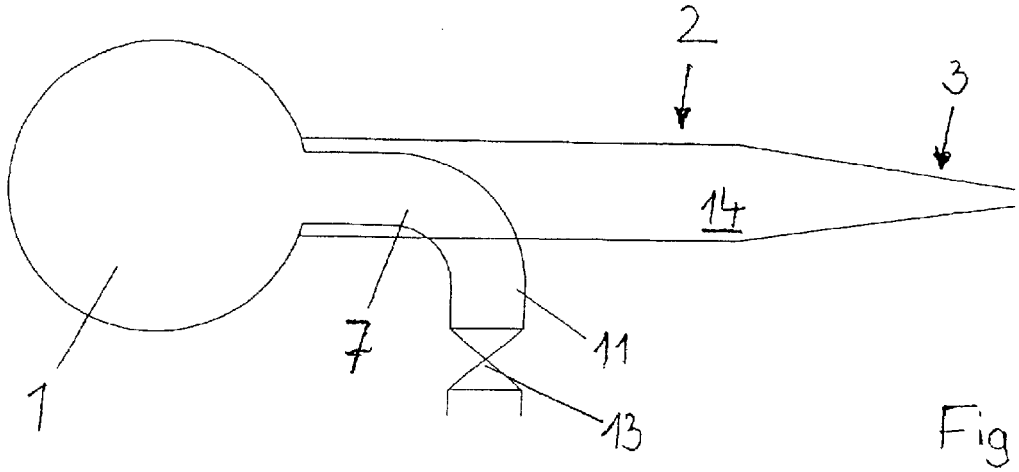
FIG. 3 is a schematic side view of a quality control system in accordance with the invention illustrating a single-layer headbox and associated return flow system.

FIG. 3 shows the side view for a single-layer headbox, with distribution pipe 1, turbulence-generating chamber 2, edge pipe 7, and discharge line 11 with control valve 13.

Figure 4:
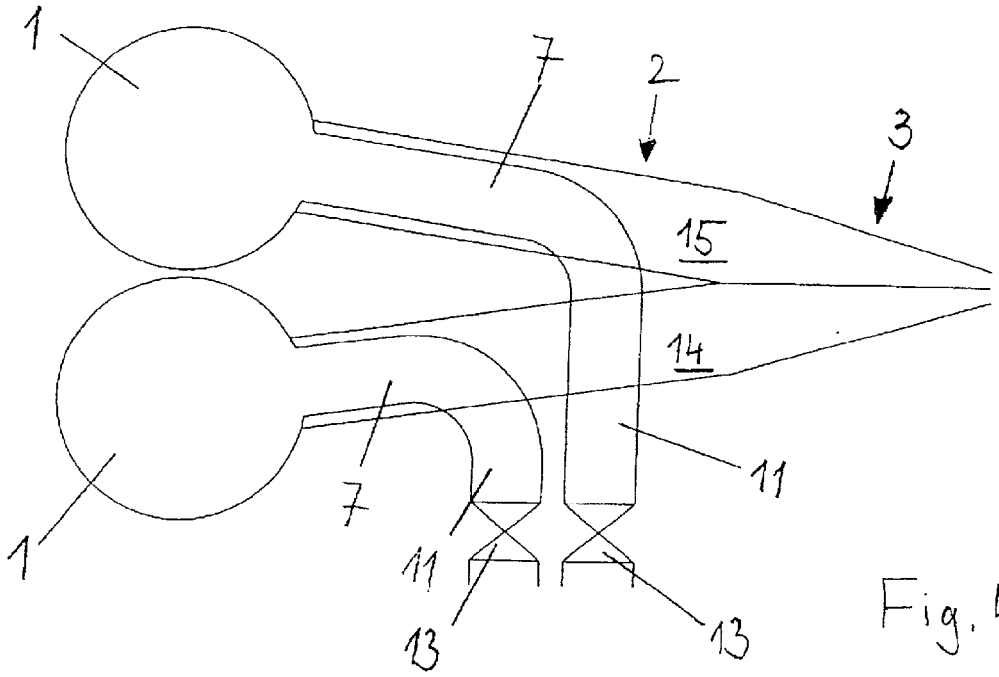
FIG. 4 is a schematic side view of a quality control system in accordance with the invention illustrating a two-layer headbox and associated return flow systems.
Figure 5:
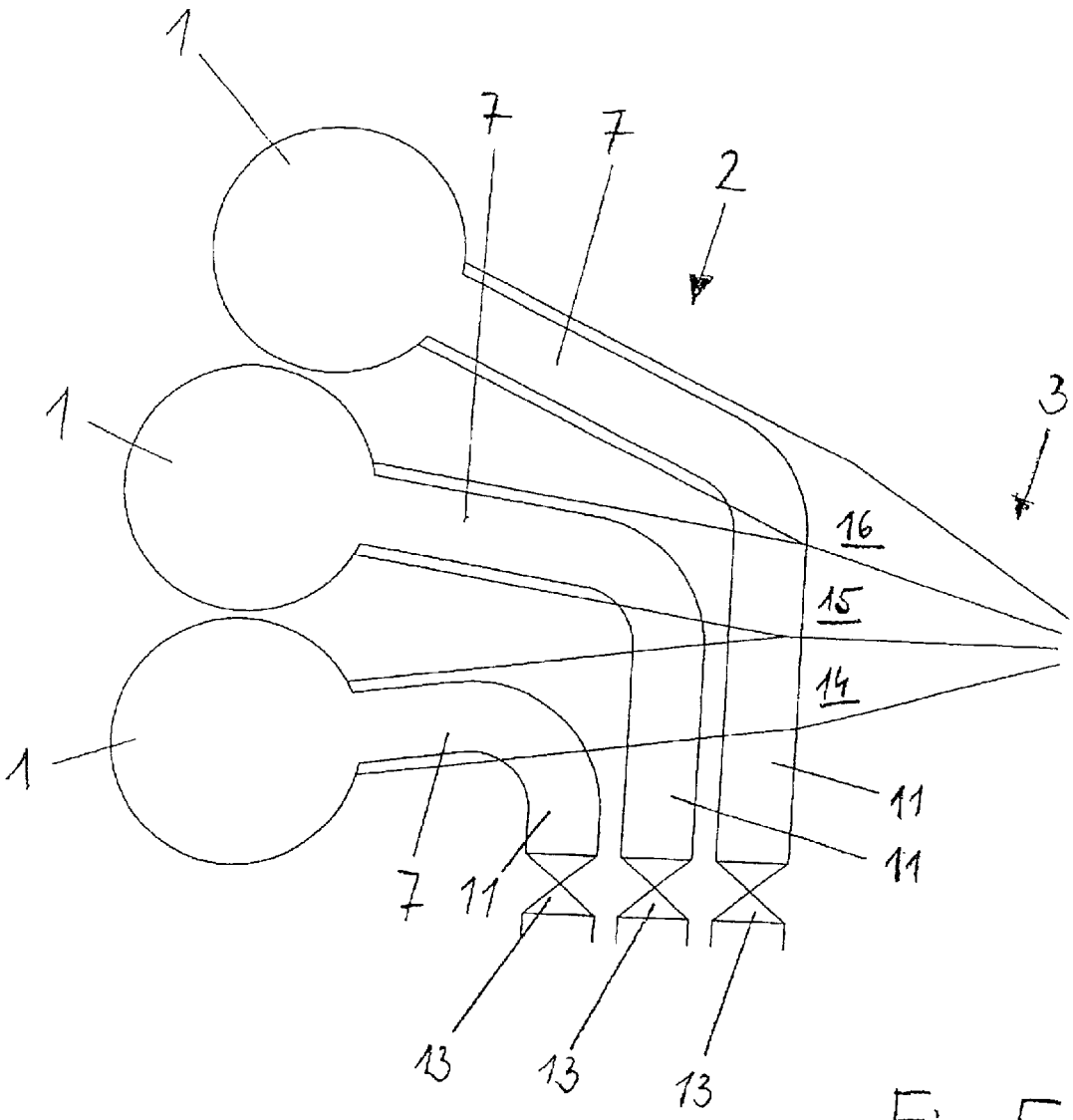
FIG. 5 is a schematic side view of a quality control system in accordance with the invention illustrating a three-layer headbox and associated return flow systems.

FIG. 4 shows an appropriate arrangement for a two-layer headbox and FIG. 5 a three-layer headbox. The individual layers are marked 14, 15 and 16. This figure shows that the edge pipes 7, 8 can also be shortened to suit the arrangement, so that they can then run alongside one another out of the machine. As a basic principle, the lines 11 could also converge right away in the turbulence-generating chamber and only be controlled by one common control valve.

With the present invention, an appropriate modification made right at the start of the dewatering plant, e.g. of a tissue or paper machine, can avoid the poor quality edge strips being produced. As a result, the output of a plant can be increased by up to 5% compared with conventional plants of the same width. In addition, there is none of the broke previously produced, which had to be recycled and thus, taken into consideration in sizing the broke preparation section.

The invention is not only suitable for use in paper or tissue machines, but can also be used in pulp dewatering machines.

While preferred embodiments have been shown and described, various modifications and substitutions may be made thereto without departing from the spirit and scope of the invention. Accordingly, it is to be understood that the present invention has been described by way of illustration and not limitation.

What is claimed is:

1. Apparatus for controlling quality parameters of a pulp sheet in a dewatering section of plants for producing paper, tissue or pulp from a pulp suspension, the quality parameters including basis weight cross-profile, formation, and fiber direction, the apparatus comprising at least one headbox, each headbox defining a pulp suspension flow path, each headbox including:

a suspension feed device;

a distribution device comprising a distribution chamber adapted for discharging the pulp suspension from the headbox, the distribution chamber extending laterally across the flow path from a first side to a second side, the first and second sides of the distribution chamber defining a sheet width; and a turbulence-generating chamber adapted for receiving the pulp suspension from the feed device, the turbulence-generating chamber extending laterally across the flow path from a first side to a second side and including a first peripheral zone extending laterally from the first side of the turbulence-generating chamber to the first side of the distribution chamber, a second peripheral zone extending laterally from the second side of the turbulence-generating chamber to the second side of the distribution chamber, and a plurality of pipes extending in the direction of the flow path, each of the peripheral zones having discharge means for discharging at least a portion of the pulp suspension in the associated peripheral zone from the distribution device, and drainage means for discharging excess suspension from the distribution device.

2. The apparatus of claim 1 wherein at least one of the pipes is disposed in each of the first and second peripheral zones.

3. The apparatus of claim 2 wherein each of the pipes has a length, the length of the pipes in the peripheral zones being less than the length of the pipes which are not in the peripheral zones.

4. The apparatus of claim 1 further comprising first and second collecting lines in fluid communication with the pipes in the first and second peripheral zones, respectively.

5. The apparatus of claim 4 wherein each of the collecting lines includes a control valve.

6. The apparatus of claim 4 further comprising a single control valve controlling flow in all of the collecting lines.

7. The apparatus of claim 3 wherein the length of the pipes in the peripheral zones are substantially one quarter of the length of the pipes which are not in the peripheral zones.

8. Process for controlling quality parameters of a pulp sheet in a dewatering section of plants for producing paper, tissue or pulp from a stream of pulp suspension, the quality parameters including basis weight cross-profile, formation, and fiber direction, the dewatering section including at least one headbox having a suspension feed, a distribution device having laterally spaced first and second side edges and first and second edge zones extending laterally outward from the first and second side edges, respectively, and discharge means for removing excess suspension from the distribution device, the process comprising draining off a portion of the stream pulp suspension in both edge zones of the distribution device.

9. The process of claim 8 wherein the distribution device has input and output ends and third and fourth side edges disposed laterally outward of the first and second side edges, respectively, the third and fourth side edges of the distribution device deflecting a portion of the stream of the pulp suspension at the input end of the distribution device, the deflected portion of the stream of pulp suspension being the portions of the stream of pulp suspension in the edge zones of the distribution device.

10. The process of claim 8 also comprising the step of regulating the draining of the portions of the stream of pulp suspension.

11. The process of claim 8 wherein the dewatering section includes a plurality of headboxes, a portion of the stream of pulp suspension in both edge zones of the distribution device of each headbox being drained.

* * * * *